US008186421B1

(12) United States Patent
Carter et al.

(10) Patent No.: US 8,186,421 B1
(45) Date of Patent: May 29, 2012

(54) CORELESS POLE MOLD AND METHOD OF MAKING SAME

(75) Inventors: Joseph F. Carter, Warsaw, OH (US); Steven G. Meisel, Coshocton, OH (US); Keith W. Mallet, Newark, OH (US)

(73) Assignee: McWane Global, Birmingham, AL (US)

( * ) Notice: Subject to any disclaimer, the term of this patent is extended or adjusted under 35 U.S.C. 154(b) by 113 days.

(21) Appl. No.: 12/498,803

(22) Filed: Jul. 7, 2009

(51) Int. Cl.
*B22D 13/02* (2006.01)
*B22D 13/10* (2006.01)

(52) U.S. Cl. ..... 164/286; 164/292; 164/298

(58) Field of Classification Search ..... 164/286, 164/292, 298, 299, 301, 114, 117
See application file for complete search history.

(56) References Cited

U.S. PATENT DOCUMENTS 538,835 A * 5/1895 Kneass ..... 164/299
1,329,295 A 1/1920 De Lavaud
1,668,318 A * 5/1928 Humperdinck ..... 164/117
1,675,715 A 7/1928 Losey
2,148,802 A * 2/1939 Bunke ..... 164/297
2,152,717 A * 4/1939 Wehmeieret et al. ..... 164/59.1
5,784,851 A * 7/1998 Waugh ..... 52/848
2008/0023172 A1 * 1/2008 Waugh ..... 164/114
* cited by examiner

*Primary Examiner* — Kevin P Kerns
(74) *Attorney, Agent, or Firm* — C. Brandon Browning; Maynard Cooper & Gale, PC

(57) ABSTRACT

A utility pole mold including an elongated, hollow mold body having an internally tapered end and a reservoir extending radially out therefrom. A reusable barrier member is detachably secured to the at least one wall opposite the tapered end for containing a molten metal within the reservoir. In use, a lance is inserted into the mold body and a pouring end of the lance is positioned about the reservoir. The mold body and reservoir are then rotated, and the molten metal is poured from the pouring end at a constant rate. As the lance travels along the length of the mold body at an accelerating rate, a continuous layer of the molten material is deposited within the mold body and the reservoir. Following casting, the barrier is removed from the reservoir, and the newly formed utility pole is removed from mold. That portion of the pole that was formed within the reservoir portion is then removed to provide a pole having a bottom end with a desired wall thickness and interior taper.

16 Claims, 5 Drawing Sheets

CORELESS POLE MOLD AND METHOD OF MAKING SAME

FIELD OF THE INVENTION

The present invention relates to an apparatus and method of using same for making a hollow, centrifugally cast utility pole, and more particularly to a centrifugal-casting mold and method of using same for controlling the inner diameter of an end of a centrifugally cast, ductile iron pole.

BACKGROUND OF THE INVENTION

The oldest known method in the art of utility pole construction is the use of wooden poles, such as those commonly used for telephone lines. However, many modern utility pole uses require longer lengths than are practical, or even possible, with wood, and wood poles are highly susceptible to rot, insect infestation, bird attack and high winds. Additionally, construction of wooden poles requires that the pole be of one piece of uncut wood which creates difficulties in transporting and erecting long poles. To overcome the shortcomings of wood utility poles, solid concrete poles are often used. Concrete utility poles, however, are expensive to produce, heavy and require special heavy duty equipment to load, transport, unload and install. Further, the greater weight of concrete poles precludes the use of very long poles. Metal poles have long served as an alternative to wood and concrete utility poles. Metal poles are relatively strong and capable of being constructed in sections for ease of transportation and erection. The widespread use of metal poles however has been limited since steel poles are expensive to produce and aluminum alloy utility poles do not have sufficient strength to be used in high lateral force environments.

More recently, the concept of using ductile iron for utility pole construction has been suggested. It is believed that ductile iron utility poles will provide a virtually maintenance free, extremely long life, low cost utility pole. An exemplary ductile iron utility pole is disclosed in U.S. Patent Application Publication No. 2008/0023172 A2 to Waugh. The pole is a centrifugally cast utility pole having a tapered exterior and a substantially uniform wall thickness along the long axis of the pole. Additionally, U.S. Pat. No. 5,784,851 to Waugh discloses a hollow, centrifugally cast, utility pole having tapered external linear dimensions. The pole is formed utilizing conventional centrifugal casting methods wherein a tapered mold is used to impart a tapered shape to the pole. The use of the tapered mold during the casting operation also provides for a gradually increasing pole wall thickness along the entire length of the pole from the top of the pole to its butt.

Metal utility poles such as the centrifugally cast, tapered poles described above are fabricated to provide for a press-fit, slip joint at the butt of the poles which allows the poles to be interconnected with other similarly cast poles for extended height. To provide such a joint, it is important that bottom ends of the poles have a tapered interior surface that is complimentary with the tapered exterior top ends of the poles to ensure full contact between the top ends and the bottom ends of the poles when they are interconnected. Obtaining the desired taper along the exteriors of the top ends of the poles is a relatively simple endeavor since the exteriors of the poles are determined by the inner surfaces of the molds in which they are formed. Obtaining a desired tapered interior surface along the bottom ends however is more difficult.

The conventional method for providing a centrifugally cast metal pole with a desired bottom end inner wall shape and diameter utilizes a sand core that is inserted into the bottom end of a pole mold during centrifugal casting of the pole. The sand core includes a continuous wall that projects into the mold a predetermined length and at a predetermined distance from the mold wall thereby forming a cavity between the mold wall and the core wall. This cavity ultimately defines the inner shape and diameter of the bottom end of the pole. During the casting, molten metal is introduced at the opening of the cavity, and the mold is rotated to centrifugally force the molten metal down into the cavity. It has been found, however, that this method is often insufficient for controlling the shape and inner diameter of the bottom end of poles since the joint length required for interconnecting utility poles requires the use of a core wall and cavity lengths that mold rotation and centrifugal force alone cannot completely fill with molten metal. For example, the conventional press-fit joint length between hollow metal pole members is about 1.5 times as large as the inner diameter of the butt of the pole. Thus, the core wall of a sand core used to form the interior taper of the bottom end of ductile iron pole must project a length into the mold equal to 1.5 times the inner diameter of the butt of the pole to be formed therein.

SUMMARY OF THE INVENTION

The present invention relates to a utility pole mold and method of using same for making a hollow, centrifugally cast metal pole. According to one aspect of the invention, there is provided a coreless pole mold including an elongated, hollow mold body having an internally tapered first end and an internally tapered second end, the second end having an inner diameter that is greater than that of the first end. A reservoir portion extends radially out from the second end of the mold body and includes at least one wall that is integral with the second end of the mold body. The reservoir portion is provided for collecting the molten metal that is initially discharged into the mold prior to the rate of discharge becoming constant or controlled. To contain the molten metal within the reservoir, a barrier member is detachably secured to the at least one wall opposite the second end.

According to another aspect of the invention there is provided a method for making a utility pole member using a pole mold having a tapered first end and a tapered second end having an inner diameter that is greater than that of the first end. A lance is inserted into the pole mold, typically through the first end, and positioned such that a pouring end of the lance will discharge molten metal into the second end of the mold. The mold is then rotated, and the molten metal is discharged at a constant rate into the mold. As the molten metal is discharged, either one or both of the pouring end of the lance and the first end of the pole mold are moved away from the other at an accelerating rate. By discharging the molten metal at a constant rate and accelerating the rate of travel between the lance and the mold, the wall thickness along the length of the pole can be controlled thus providing, for example, a pole having a constant wall thickness or controlled interior taper along its length.

According to yet another aspect of the invention, there is provided a method for making a utility pole member using an elongated, hollow mold body having a first end and a second end and a reservoir portion extending radially from the second end. Prior to casting, a removable barrier configured for containing a molten material within the reservoir portion during casting operations is placed within the reservoir portion opposite the second end of the mold body. Thereafter, a lance is inserted into the mold body and a pouring end of the lance is positioned about the reservoir portion. The mold body and reservoir are then rotated, and the molten metal is poured from the pouring end. As the lance travels along the length of the mold body, a continuous layer of the molten material is deposited within the mold body and the reservoir that extends to and between the first end of the mold body and the barrier. Following casting, the barrier is removed from the reservoir portion, and the newly formed utility pole member is removed from the mold. Lastly, that portion of the pole member that was formed within the reservoir portion is removed from the pole to provide a pole having a bottom end with a desired wall thickness and interior taper.

DETAILED DESCRIPTION OF PRESENTLY PREFERRED EMBODIMENTS

Figure 1:
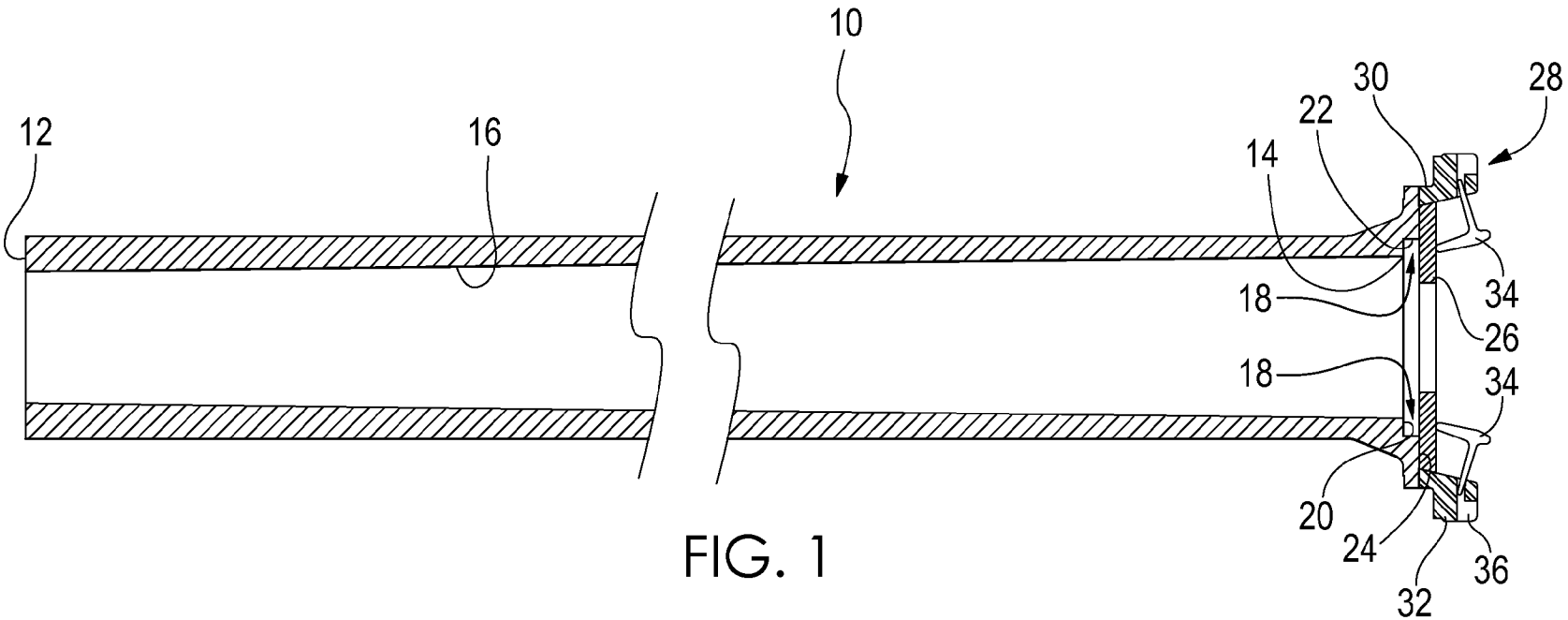
FIG. 1 is a sectional view of a utility pole mold in accordance with a preferred embodiment of the invention.
Figure 3:
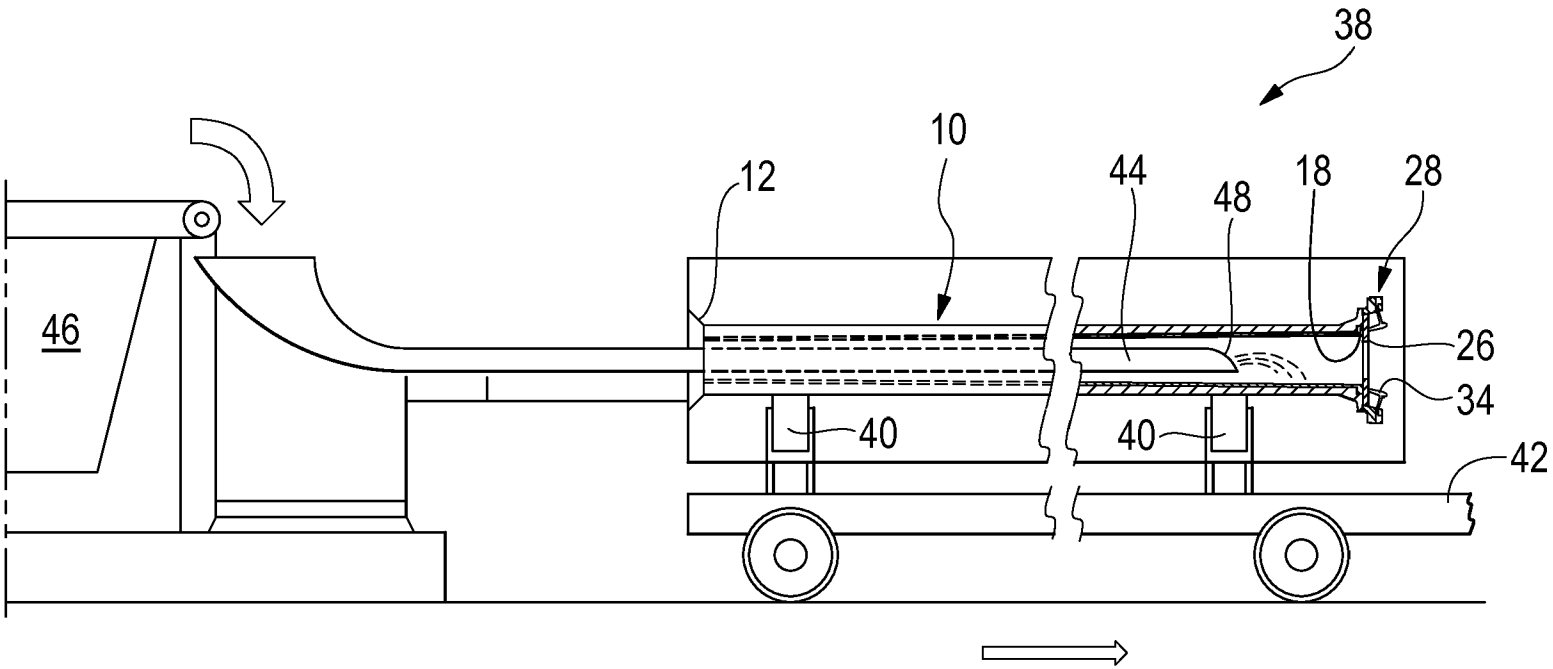
FIG. 3 is a plan view of a conventional centrifugal casting machine being used to cast an intermediate pole member utilizing the utility pole mold of FIG. 1.
Figure 4:
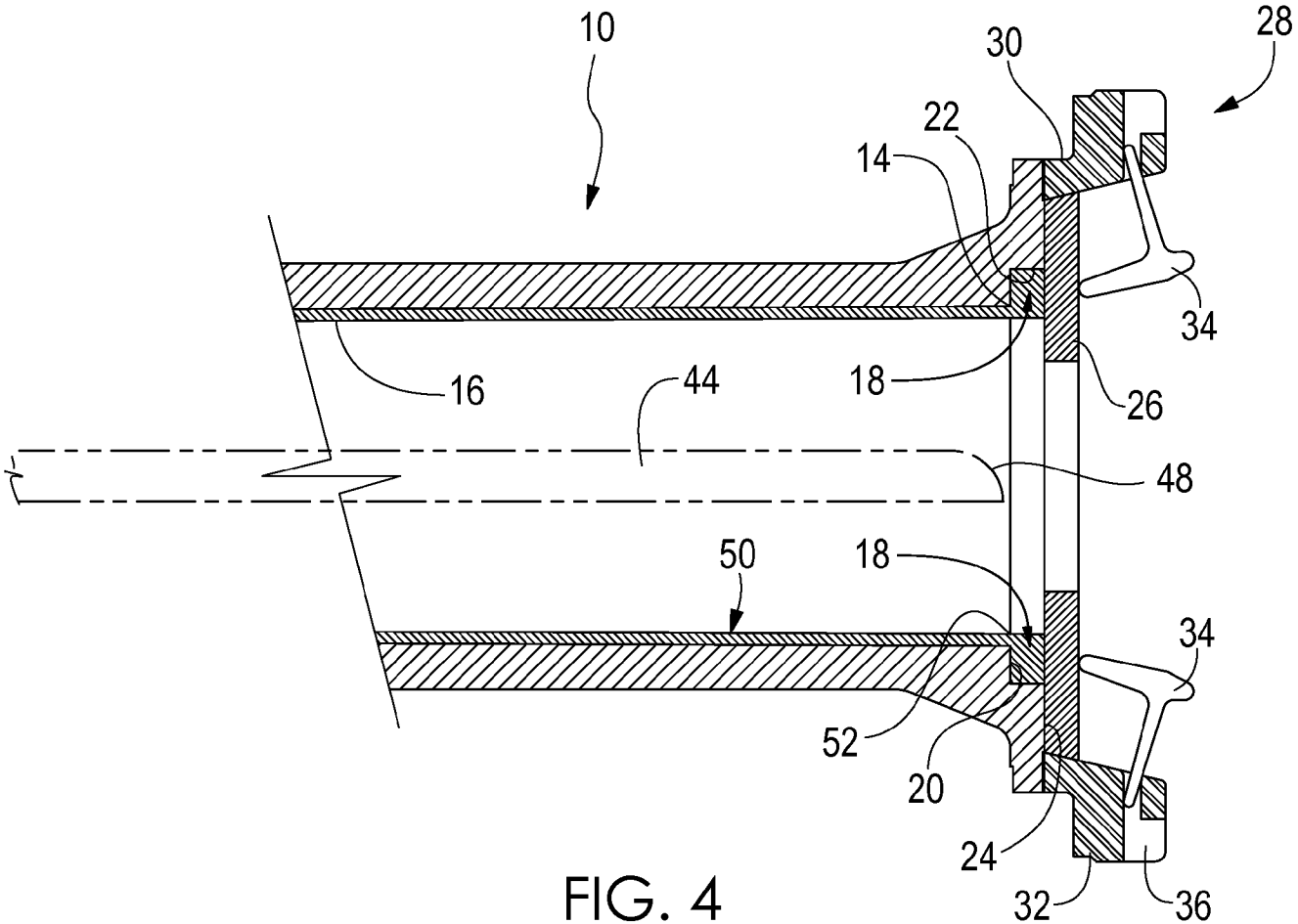
FIG. 4 is a sectional view of an end of the utility pole mold of FIG. 1 showing a bottom end of an intermediate pole member formed therein.
Figure 5:
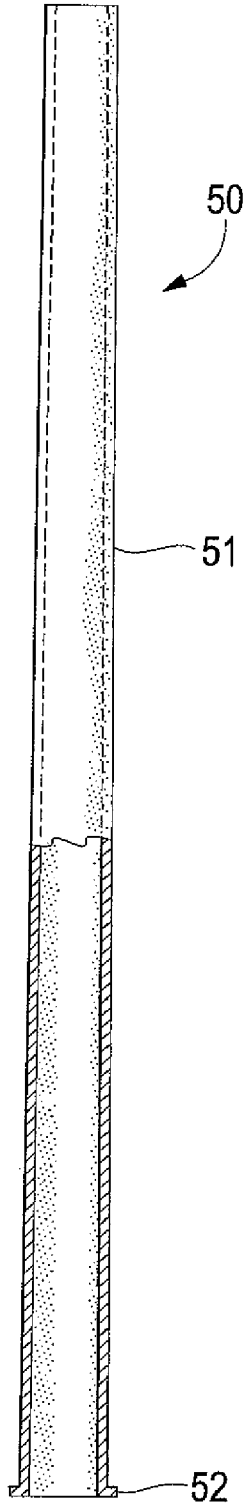
FIG. 5 is a partial sectional view of the intermediate pole member of FIG. 4.
Figure 6:
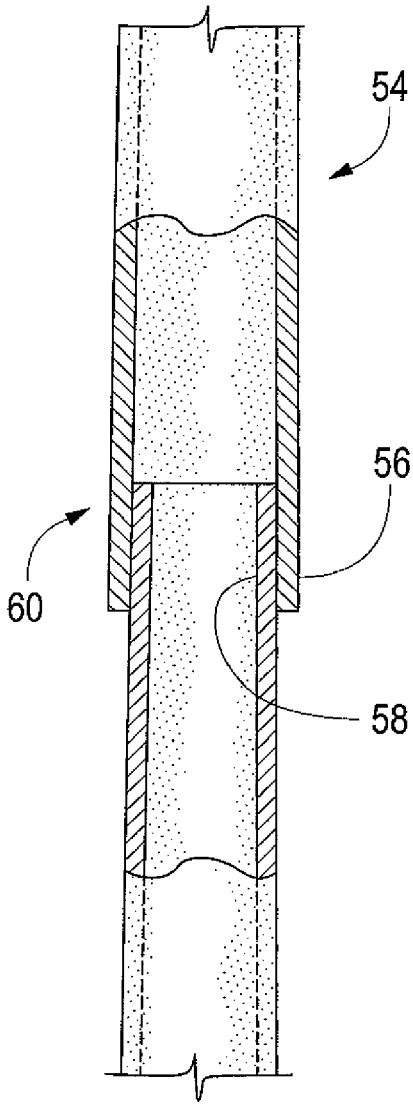
FIG. 6 is a partial sectional view of press-fit joint between pole members manufactured utilizing the utility pole mold of FIG. 1.

FIGS. 1 through 4 depict a utility pole mold and method of using same in accordance with a preferred embodiment of the present invention. FIGS. 5 and 6 depict an intermediate pole member and a pole joint formed between interconnected pole members that have been fabricated according to the preferred mold and method of FIGS. 1 through 4. In particular, FIG. 1 depicts a hollow, utility pole mold 10 of conventional construction having a first end 12, a second end 14 and a tapered interior wall 16 extending to and between ends 12 and 14. Second end 14 has an inner diameter that is greater than an inner diameter of first end 12, and thus, first end 12 is configured for forming the top ends of the centrifugally cast, ductile iron poles to be formed therein, while second end 14 is configured for forming the bottom ends of the poles.

Integrally formed with second end 14 is a reservoir portion 18. Reservoir portion 18 is in fluid communication with second end 14 of mold 10 and includes an inner surface defined by a first wall 20 that is integral with and extends radially out from second end 14. The reservoir portion inner surface is further defined by a second wall 22 that is integral with and extends perpendicularly from first wall 20. A third wall 24 extends radially out from second wall 22 and horizontally to first wall 20 but does not further define the inner surface of reservoir portion 18. Instead, third wall 24 is provided to make available a surface against which a disk-shaped removable plate 26 is pressed for partially enclosing reservoir portion 18. Together with first wall 20 and second wall 22, plate 26 provides reservoir portion 18 with a capacity to contain a predetermined amount of molten metal during casting operations.

Figure 2:
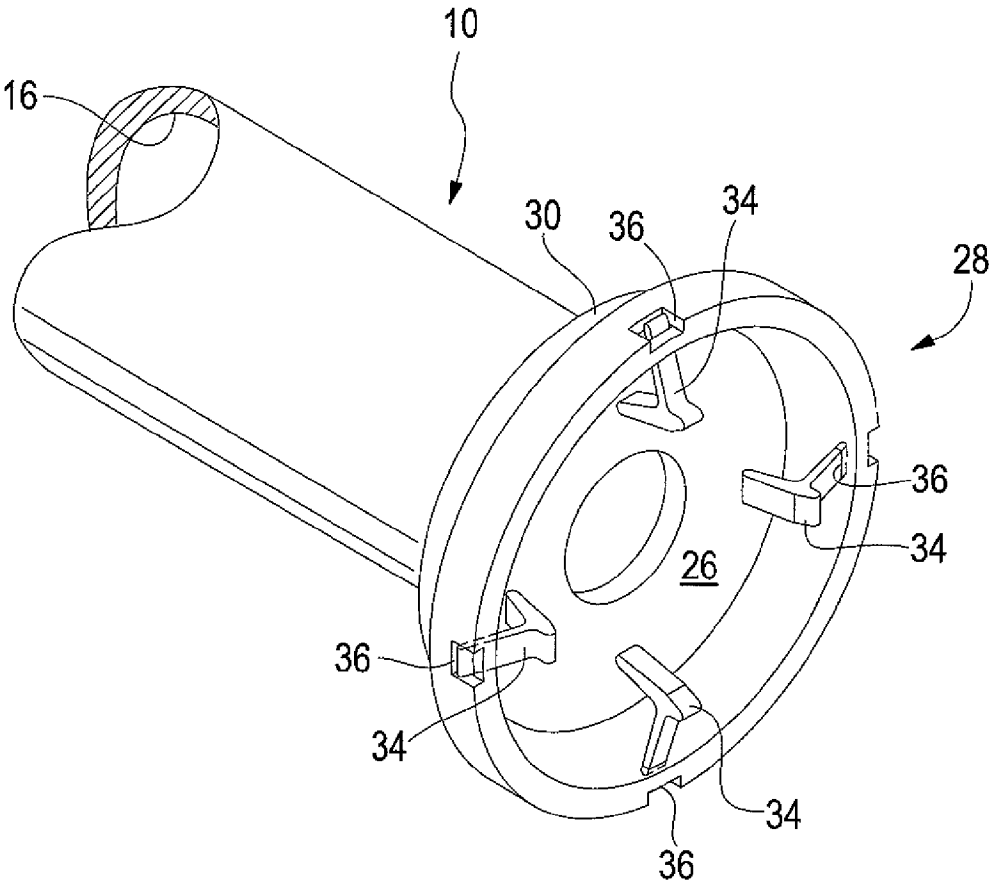
FIG. 2 is perspective view of an end of the utility pole mold of FIG. 1 supporting a rigging member.

To maintain plate 26 pressed against third wall 24, a rigging member 28 is removably coupled to the annular edge of third wall 24. As best depicted in FIGS. 2 and 4, rigging member 28 consists of a ring-shaped base member having a first annular portion 30 that is attached directly to the annular edge of third wall 24 and a second annular portion 32 integral with and extending from first annular portion 30 for supporting four hinged retainer pieces 34. First annular portion 30 forms an annular seat on which plate 26 is supported along the peripheral edge thereof as it is pressed against third wall 24. Second annular portion 32 contains a bias portion 36 for anchoring each of the retaining pieces 34 within rigging member 28. In particular, each of bias portions 36 includes a hinge for securing a retainer piece 34 therein and a bias member such as a spring, tension clip, elastic band or any other conventional tension device for pressing each of retainer pieces 34 against plate 26. Alternatively, plate 26 can be pressed against third wall 24 and maintained within rigging member 28 using a hydraulically actuated arm that extends from a base member to contact plate 26 and hold plate 26 in place against mold 10.

Mold 10, in combination with plate 26 and rigging member 28, is used to centrifugally cast ductile iron pole members having tapered exterior surfaces along the entire lengths thereof. The pole members are interconnected to form utility poles by stacking the pole members end to end, with a bottom end section of one pole member being supported directly on top of and overlapping a top end section of another like pole member. The overlap portion defines a press-fit joint between interconnected pole members. It is preferred that the press fit joint exhibits a friction fit between the pole members. This requires that the inner surface of each bottom end section of the pole members has a shape and diameter along the length thereof that are complimentary to and substantially the same as the shape and diameter of the outer surface of each top end section of the pole members.

To accomplish this complimentary arrangement between the top ends and the bottom ends of the pole members during casting operations, it is important to precisely control the dimensions of the exterior surfaces of the top end and the interior surfaces of the bottom end of each of the pole members. The outer diameter of each of the members is relatively easy to control since the outer diameter and shape of the pole members are determined by interior surface 16 of mold 10. However, control of the inner diameter of each of the pole members is more difficult to achieve since the inner diameter of the pole members is determined by the thickness of the molten metal layer deposited along mold 10. Further, controlling the thickness of the molten metal layer is especially difficult along second end 14 of mold 10, which correlates to the bottom ends of the pole members, since the initial pour rate of the molten metal is unpredictable and the initial pouring commences about second end 14. To overcome these obstacles, in the present invention, the molten metal that is initially poured into mold 10 is collected in reservoir portion 18. Once the molten pour rate stabilizes, the remaining molten metal is poured along the length of mold 10 in the direction of first end 12 at a predetermined flow rate and travel speed.

More particularly, referring to FIG. 3, there is depicted a conventional centrifugal casting apparatus 38 including mold 10 of the present invention. Casting apparatus 38 includes a mold support 40 for rotatably supporting mold 10, means for rotating mold 10 (not shown), a moveable platform 42 on which mold support 40 is carried, a lance 44 for depositing molten metal into mold 10 and a molten metal reservoir 46 in fluid communication with lance 44. During casting operations, lance 44 is inserted into mold 10 through first end 12, and a pouring end 48 of lance 44 is positioned within mold 10 about reservoir portion 18. Thereafter, mold 10 is rotated and initial pouring of the molten metal begins. Since the pour rate during the initial pouring is unpredictable, pouring end 48 of lance 44 remains stationary about reservoir portion 18 which allows the molten metal to be collected within reservoir portion 18. Plate 26, which is pressed against third wall 24 and supported by rigging member 28, contains the molten metal within reservoir portion 18. Once the molten metal pour rate becomes predictable or stable, platform 42 is advanced along a line away from molten metal reservoir 46 so that a layer of molten metal is deposited within mold 10 from second end 14 in the direction of first end 12 of mold 10. Since the molten metal pour rate is controllable during this phase of casting operations, the amount of molten metal deposited along mold 10 can be controlled, and thus, the interior dimensions of each of the pole members can also be controlled. It is preferred that the molten metal pour rate along interior surface 16 of mold 10, after the initial pour, remains constant. It is also preferred that the pole members have a constant wall thickness. Using a constant pour rate to provide a constant pole member wall thickness is accomplished by accelerating the travel speed between pouring end 48 of lance 44 and mold 10 as lance 44 is advanced from second end 14 toward first end 12. This way, less molten metal is deposited along mold 10 as the inner diameter of mold 10 decreases along tapered interior 16. Thus, pouring end 48, while pouring molten metal at a constant rate, spends less time within a section of mold 10 as pouring end 48 approaches first end 12 of mold 10.

As depicted in FIG. 4, upon conclusion of casting operations, there is provided within mold 10 an intermediate pole member 50 that extends to and between first end 12 to plate 26 and that fills reservoir portion 18. Intermediate pole member 50 includes a tapered exterior portion 51, as depicted in FIG. 5, extending between first end 12 and second end 14 and a constant wall thickness. Intermediate pole member 50 further includes a bottom portion 52 formed within reservoir portion 18 and thus exhibits dimensions complimentary with portion 18. To remove intermediate pole member 50 from mold 10, each retainer piece 34 of rigging member 28 is biased away from plate 26, and plate 26 is unseated from rigging member 28. This provides access to second end 14 of mold 10 and reservoir portion 18. Intermediate pole member 50 is then removed from mold 10 through rigging member 28.

Since initial pouring is unpredictable as describe above, bottom portion 52 of intermediate pole member 50 may include irregularities in wall thickness that are removed by cutting bottom portion 52 from intermediate pole member 50 to provide a finished pole member 54. Cutting occurs at a predetermined point along intermediate pole member 50 to ensure that a bottom end 56 of finished pole member 54 is complimentary with a top end 58 of a like pole member so that the pole members can be interconnected about a press-fit joint 60, as depicted in FIG. 6.

As will be apparent to one skilled in the art, various modifications can be made within the scope of the aforesaid description. Such modifications being within the ability of one skilled in the art form a part of the present invention and are embraced by the claims below.

It is claimed:

1. A coreless pole mold comprising, an elongated, hollow mold body having an internally tapered first end and an internally tapered second end, the second end having an inner diameter that is greater than that of the first end, a reservoir portion extending radially out from the second end of the mold body, the reservoir portion including at least one wall that is integral with the second end of the mold body, and a barrier member detachably coupled to the at least one wall opposite the second end, the barrier member being configured for containing a molten metal material within the reservoir portion during centrifugal casting operations, wherein the pole mold excludes a core mold.

2. The mold according to claim 1 further comprising a layer of the molten material centrifugally cast within the coreless pole mold wherein the layer extends to and between the first end of the mold body and the barrier member.

3. The mold according to claim 2 wherein the molten material extends across and is in direct contact with the second end and the at least one wall.

4. The mold according to claim 3 wherein the barrier member is configured and arranged in combination with the mold body in a manner that the barrier member does not restrict radial growth of the molten metal material within the reservoir portion.

5. The mold according to claim 3 wherein the barrier member does not extend into a cavity defined by the reservoir portion.

6. The mold according to claim 3 wherein the layer of the molten material within the reservoir portion is not located between an axially extending surface of the barrier member and the at least one wall of the reservoir portion.

7. The mold according to claim 3 wherein the molten metal material within the reservoir portion has an inner surface and an opposing outer surface that is in contact with the at least one wall of the reservoir portion, the inner surface having an axially extending contour that is independent of the barrier member.

8. The mold according to claim 3 wherein the molten metal material within the reservoir portion has an inner surface and an opposing outer surface that is in contact with the at least one wall of the reservoir portion and wherein the barrier member does not extend substantially parallel to the inner surface.

9. The mold according to claim 1 further comprising a centrifugally cast, ductile iron pole formed within the coreless pole mold and extending to and between the first end of the mold body and the barrier member, the pole having a bottom section formed within the second end of the mold body and the reservoir portion, wherein that portion of the bottom section that was formed within the second end of the mold body is not in contact with the barrier member.

10. The mold according to claim 9 wherein that portion of the bottom section that was formed within the reservoir portion is in contact with the barrier member.

11. The mold according to claim 1 wherein the barrier member does not extend into a cavity defined by the second end of the mold body.

12. The mold according to claim 1 further comprising a rigging member coupled to the at least one wall, the rigging member including a seat which supports the barrier member along a peripheral edge of the barrier member.

13. The mold according to claim 1 further comprising a rigging member coupled to the at least one wall, the rigging member including a plurality of retainer pieces configured for pressing the barrier member against the at least one wall.

14. The mold according to claim 1 wherein the barrier member does not extend into a cavity defined by the reservoir portion.

15. The mold according to claim 1 wherein the barrier member includes an inwardly facing surface arranged adjacent to the reservoir portion and an opposing, outwardly facing surface, wherein the inwardly facing surface is essentially flat.

16. The mold according to claim 1 wherein the barrier member is pressed directly against an outermost free edge of the reservoir portion.

* * * * *